United States Patent [19]

Dixon

[11] 4,362,425

[45] Dec. 7, 1982

[54] ROAD MARKER

[76] Inventor: Byron P. Dixon, 4574 S. 700 East #3, Salt Lake City, Utah 84107

[21] Appl. No.: 216,796

[22] Filed: Dec. 16, 1980

[51] Int. Cl.[3] ..... E01F 9/04

[52] U.S. Cl. ..... 404/16; 404/11

[58] Field of Search ..... 404/16, 15, 11, 10, 404/9; 52/189; 116/63 R, 202; 350/103, 105

[56] References Cited

U.S. PATENT DOCUMENTS

| | | | |
|---|---|---|---|
| 2,192,878 | 3/1940 | Beebe | 404/16 X |
| 2,256,636 | 9/1941 | Abbott | 404/16 |
| 3,257,552 | 6/1966 | Converso | 404/16 X |
| 3,466,985 | 9/1969 | Richardson et al. | 404/11 |
| 3,587,416 | 6/1971 | Flanagan | 404/9 |
| 3,703,855 | 11/1972 | Converso | 404/11 |
| 3,924,958 | 12/1975 | Rowland | 404/15 |
| 4,008,973 | 2/1977 | Montigny | 404/16 |
| 4,111,581 | 9/1978 | Auriemma | 404/10 |
| 4,130,370 | 12/1978 | Kone | 404/11 |
| 4,232,979 | 11/1980 | Johnson, Jr. et al. | 404/16 |

FOREIGN PATENT DOCUMENTS

| | | | |
|---|---|---|---|
| 2147525 | 9/1971 | Fed. Rep. of Germany | 404/16 |
| 436290 | 10/1935 | United Kingdom | 404/16 |
| 1021718 | 3/1966 | United Kingdom | 404/11 |
| 1372878 | 11/1974 | United Kingdom | 404/10 |

*Primary Examiner*—Nile C. Byers, Jr.
*Attorney, Agent, or Firm*—B. Deon Criddle

[57] ABSTRACT

An economical retro-reflective roadway marker of high strength plastic materials having a reflective top assembly having a resilient portion that is curved to raise the reflective top assembly and a recessed base assembly or roadway depression. The reflective top assembly comprises a series of steps having reflective tape or other reflective material on the step risers. The steps interconnect spaced apart, parallel curved sidewalls that raise the steps above a road surface. The curved sidewalls serve to guide snowplow blades, or the like, over the steps as the resilient portion of the top surface is flexed downwardly. An end base plate forms a continuation of the steps. When it is only necessary to provide reflection for one-way traffic, the end base plate is secured to the road surface and a depression is made in the road surface to receive the top assembly. As a wheel, snowplow blade, or the like, passes over the marker, the resilient portion temporarily deflects down into the depression, thereafter returning to its prior position. For two-way traffic, however, a modified upper assembly and a special base assembly are provided. The modified upper assembly consists of steps arranged in a corbiestep configuration, and an end base plate at each end of the corbiestep configuration. The base assembly comprises a base plate curved to fit a depression in the road surface and slotted guides formed in the corners of the base sheet in which the crossbars of the crossbar projections reciprocate. When a load is applied causing the top assembly to deflect down into the curved base sheet, the ends of the top assembly and the projections are moved outwardly within the slotted guides. As the load passes, the top assembly resiliently restores itself to its former undepressed position with the projections moving inwardly.

3 Claims, 7 Drawing Figures

ROAD MARKER

BACKGROUND OF THE INVENTION

1. Field of the Invention

This invention relates to retro-reflective highway markers suitable for assisting drivers at night and during storms and is particularly concerned with such markers that are particularly adaptable for use in climates necessitating snow removal operations where the markers are continuously subjected to being disloged.

2. Prior Art

As is well known, reflecting markers have long been used as a means of delineating the traffic control lines of a highway. Generally, these devices have employed reflectorized tape or a special reflecting assembly and where snowplow operation is necessary a special means for guiding the snowplow blade up over the marker and/or for rigidly attaching the marker to the road surface to prevent the marker from dislodging as the snowplow blade passes over it. U.S. Pat. Nos. 3,396,639; 3,587,416 and 4,035,059 for example, each disclose a device utilizing reflectorized tape on rigid base structures. U.S. Pat. No. 3,924,958 discloses a marker having a resiliently depressible cap and employs a detailed prism reflector assembly.

Objects and Features of the Invention

Inasmuch as many of the past highway markers have proven relatively costly to purchase, install and maintain, it is a primary object of the present invention to provide a low-cost but durable retro-reflective highway marker that is economical and simple to install and replace.

A further object of the present invention is to provide such a retro-reflective highway marker that is readily usable in climates requiring snow removal and that will not be damaged by snow removal equipment.

Yet another object of the present invention is to provide such a highway marker having a raised reflective top assembly that will depress upon being engaged by a vehicle to be level with the ground surface and that will thereafter resume its original raised condition.

Principal features of the present invention include a top assembly and, in the case of the preferred embodiment, a base assembly. The top assembly comprises a set of steps each extending transverse to the flow of traffic and interconnecting parallel, spaced apart sidewalls. The sidewalls serve to guide wheels, snowplow blades and the like over the stairs and are rigidly attached to a high strength, flexible plastic support sheet of corresponding curvature that will flex to place the upper edges of the sidewalls at ground level. In the preferred embodiment, ends of the support sheet extending transverse to the flow of traffic are provided with crossbar projections. In addition, a base assembly is provided having a base sheet curved to fit a depression in the roadway. The base assembly further includes a set of guide slots in which the crossbar projections glide. One or more of the crossbar projections may be spring loaded to facilitate easy replacement.

Additional objects and features of the invention will become apparent from the following detailed description taken together with the accompanying drawings.

DRAWINGS

Figure 3:
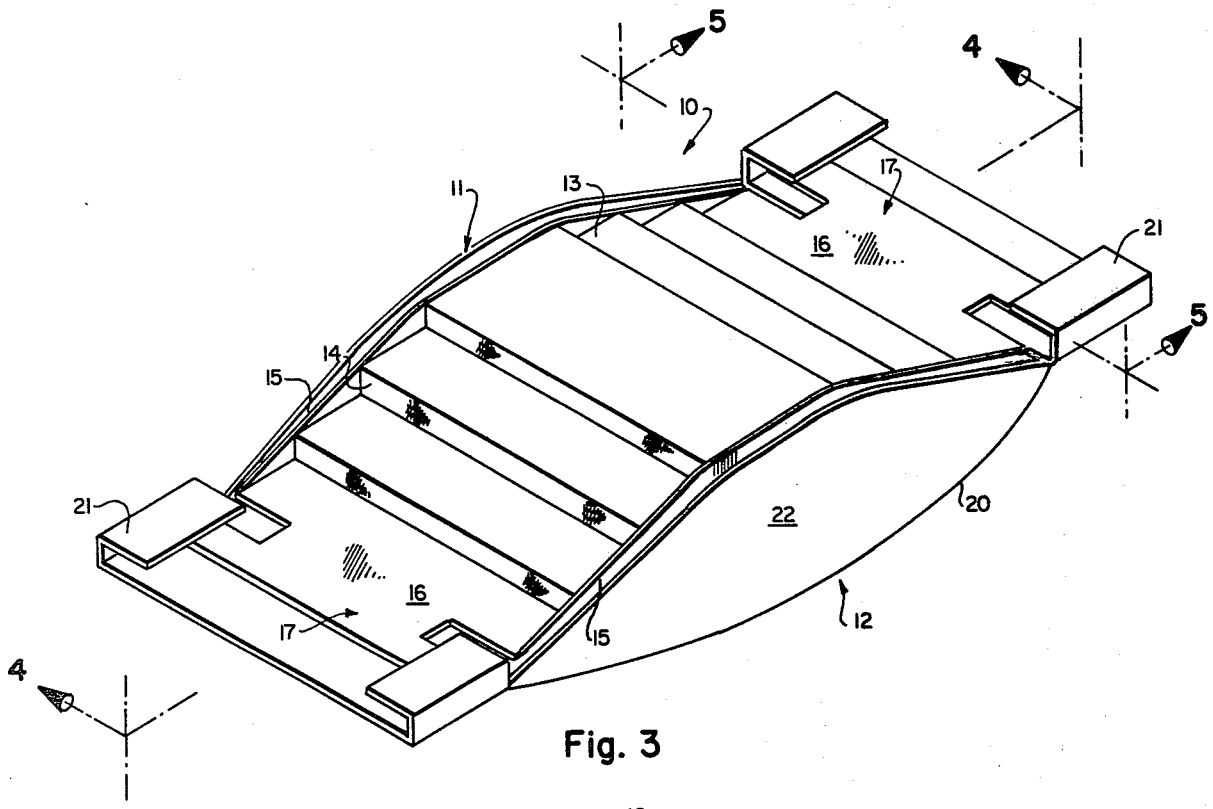
FIG. 3 is a perspective view of the preferred embodiment of the present invention showing the combined top and base assemblies of FIGS. 1 and 2, respectively.
Figure 4:
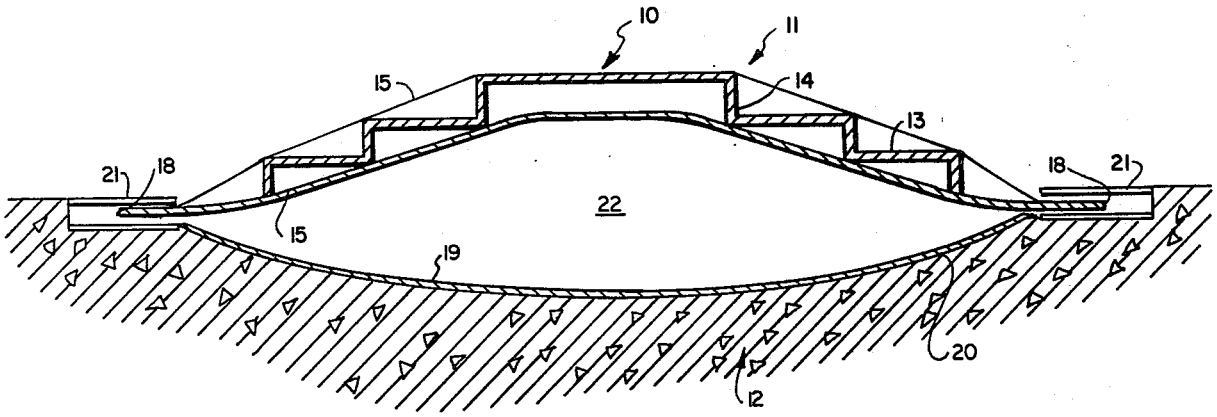
Figure 5:
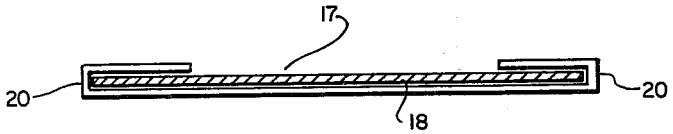
Figure 6:
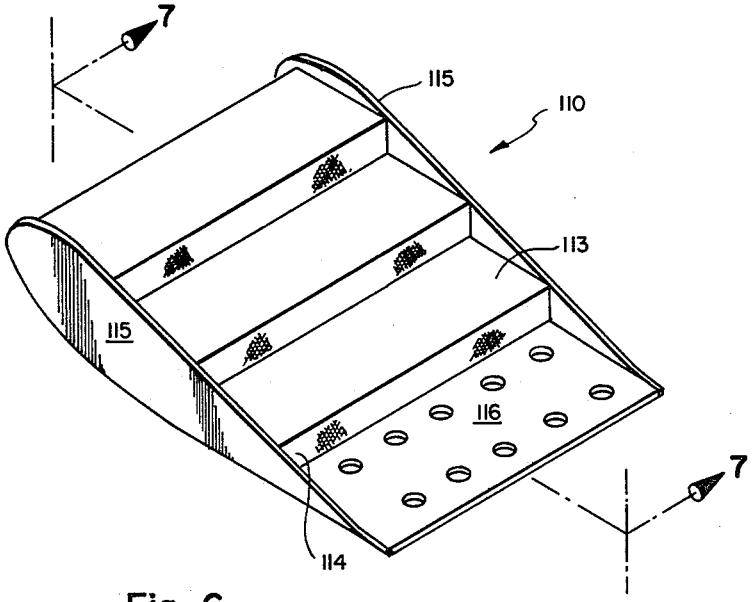

FIG. 4, a longitudinal cross sectional view taken along line 4—4 of FIG. 3 of the preferred embodiment of the present invention, shown embedded in a roadway;

FIG. 5, a cross-sectional elevation view taken along the line 5—5 of FIG. 3;

FIG. 6, a perspective view of a second embodiment of the present invention; and

7, a longitudinal, cross-sectional view taken along the line 7—7 of FIG. 6.

DETAILED DESCRIPTION

Figure 1:
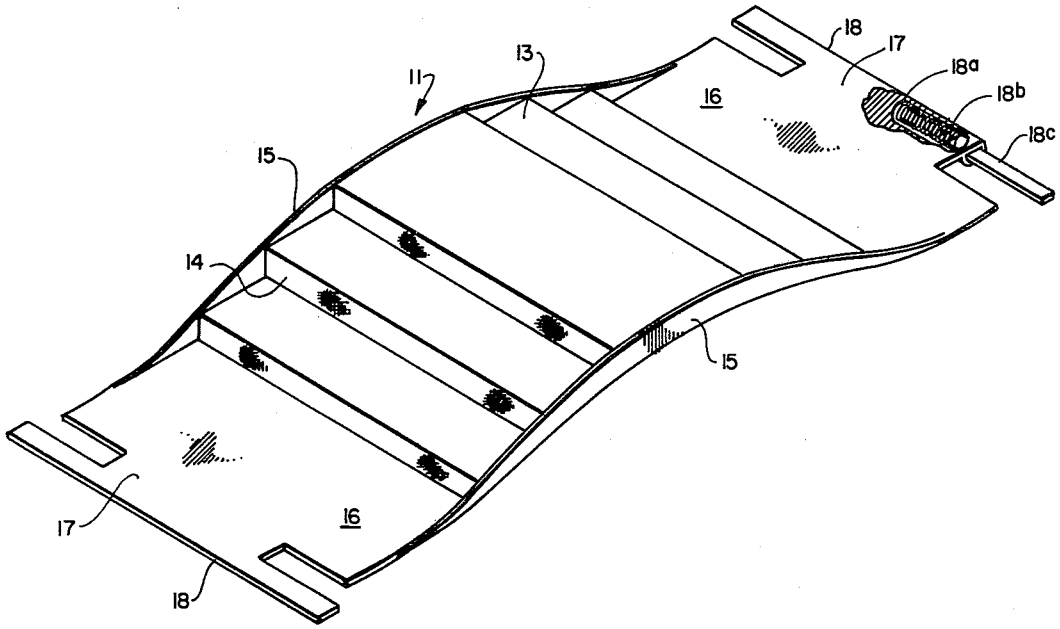
FIG. 1 is a perspective view of the base assembly of the preferred embodiment of the present invention.

Referring now to the drawings:

The preferred embodiment of the retro-reflective highway marker 10 of the present invention is illustrated in FIGS. 1–5 and, as shown, has a top assembly 11 and a base assembly 12. The top assembly 11, as best shown in FIG. 1, comprises a set of steps 13 made of a high strength material such as a suitable plastic arranged in a corbiestep configuration and with reflectorized tape 14 or other reflective material on the vertical step surfaces. The steps 13 are positioned to extend normal to the flow of traffic and interconnect two curved sidewalls 15 also made of the high strength material used for the steps. The curved sidewalls 15 serve to guide tires, snowplow blades and the like up over the steps 13 and are rigidly attached to a high strength plastic and support plates or sheets 16 forming continuations at the end of the steps and terminating in projections 17 with crossbars 18 extending transversely across each end. As illustrated at least one end of a crossbar 18 may be formed as a sleeve **18*a* with a spring 18*b* therein to act against a rod 18*c* that telescopes inside and projects from the sleeve 18*a***.

Figure 2:
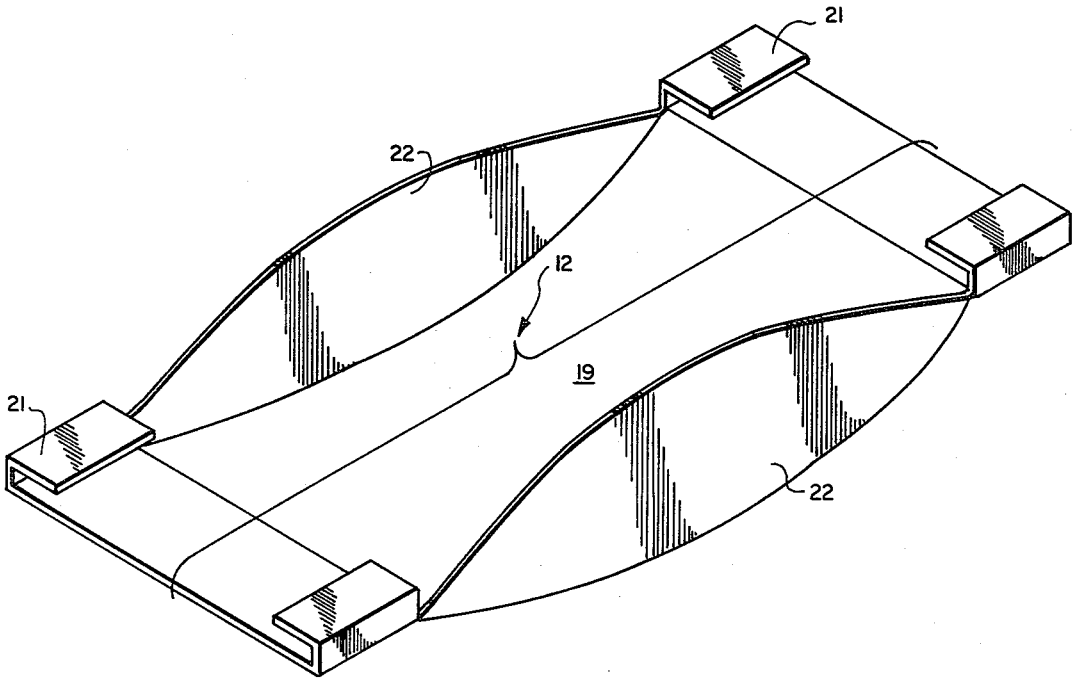
FIG. 2 is a perspective view of the base assembly of the preferred embodiment of the present assembly.

The base assembly 12, as best seen in FIGS. 2, 4 and 5 comprises a base sheet 19 curved to fit within a depression 20 formed in a roadway and cemented into or otherwise secured to the roadway. Guide slots 21 are formed on the ends of the base sheet 19 that are positioned transverse to traffic flow. As seen in FIGS. 3–5, when the top and base assemblies 11 and 12 are joined the crossbars 18 of T-shaped runners 17 are positioned within the guide slots 21. The spring loaded rod **18*c* of crossbar 18** facilitates positioning of the top assembly in the base assembly.

With the spring loaded end, all other ends 18 can be inserted into guide slots 21 and then the sleeve **18*c* can be telescoped into sleeve 18*a* while compressing spring 18*b*. The sleeve 18 is then released to be biased by spring 18*b* into its guide slot 21. Upon application of a load to the top assembly, the curved sidewalls 15 and the steps 13 together with the attached end sheets 16 deflect down into the depression 20 of the curved base sheet 19. In addition, the crossbars 18 of the projections 17 are forced to glide within the slotted guides 21. As the load is removed, the top resilient top assembly 11** elastically resumes its former bowed condition.

Upstanding flexible sidewalls 22 at opposite sides of the base assembly fit closely against side edges of the top assembly as the top assembly deflects into and out of the depression formed by base sheet 19. The sidewalls keep rocks, ice and other debris from collecting beneath the top assembly 11 to interfere with the flexing thereof.

Figure 7:
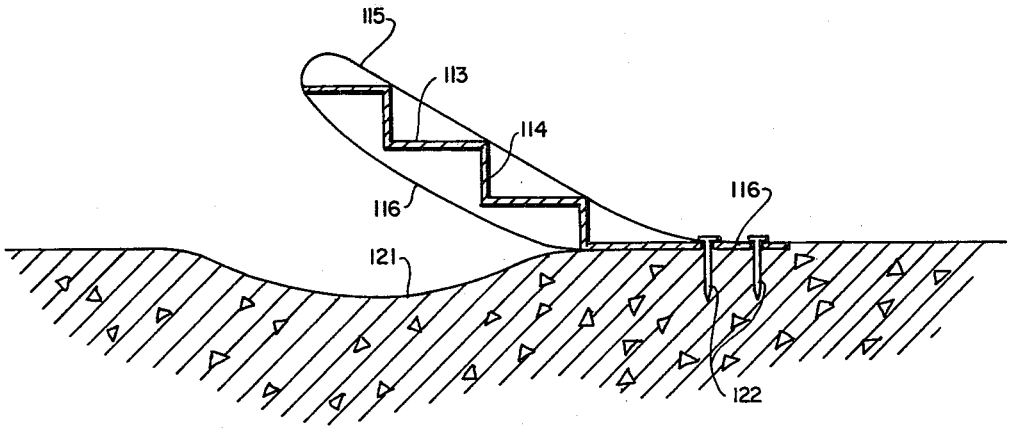

In the embodiment of the invention shown in FIGS. 6 and 7, the marker 110 includes steps 113 arranged in a simple stair configuration. Reflectorized tape 114 or other reflective material is applied to the vertical surfaces and the steps interconnect two spaced apart curved sidewalls 115. As in the embodiment previously disclosed, the sidewalls 115 prevent a tire, snowplow blade or the like from engaging the steps 113. An end support sheet 116 is provided between sidewalls 115 and serves as a lead in extension to the steps 113. The support sheet 116 is fixed and curves upwardly to the steps 113. Nails 122, epoxy resin, or other suitable means are used to anchor the support sheet 116 to the roadway surface.

When a load is applied to the marker 110, the free end of the support sheet 116 together with the attached steps 113 and sidewalls 115 deflect down into a depression 121 formed in the roadway. As the load passes by, the marker 110 resiliently resumes its former upwardly curved condition.

Although a preferred form of our invention has been herein disclosed, it is to be understood that the present disclosure is by way of example and that variations are possible without departing from the subject matter coming within the scope of the following claims, which subject matter we regard as our invention.

I claim:

1. A retro-reflective highway marker for delineating traffic control on a roadway, said highway marker comprising a curved top assembly of high strength, resilient materials that deflects into a depression, said top assembly comprising a set of steps arranged in cobbiestep configuration, an end support plate at each opposite end of the steps and a crossbar with projections extending from each support plate; and a base assembly having a curved base plate means arranged to form a depression to receive the top assembly and guide means to receive the projections.

2. A marker as in claim 1 wherein at least one projection is spring loaded to be retractible so as to facilitate mounting of the top assembly to the base assembly.

3. A marker as in claim 2, further including side walls projecting upwardly from the base assembly alongside the top assembly to prevent debris accumulation between the top assembly and the bottom assembly.

* * * * *